US008763388B2

(12) United States Patent
Payne

(10) Patent No.: US 8,763,388 B2
(45) Date of Patent: Jul. 1, 2014

(54) HYDRAULIC SYSTEM HAVING A BACKPRESSURE CONTROL VALVE

(75) Inventor: Wesley Thomas Payne, Plainfield, IL (US)

(73) Assignee: Caterpillar Inc., Peoria, IL (US)

( * ) Notice: Subject to any disclaimer, the term of this patent is extended or adjusted under 35 U.S.C. 154(b) by 972 days.

(21) Appl. No.: 12/874,244

(22) Filed: Sep. 2, 2010

(65) Prior Publication Data

US 2011/0083762 A1 Apr. 14, 2011

Related U.S. Application Data

(60) Provisional application No. 61/251,078, filed on Oct. 13, 2009.

(51) Int. Cl.
*F15B 13/08* (2006.01)

(52) U.S. Cl.
USPC ..... 60/466; 60/461; 91/442

(58) Field of Classification Search
USPC ..... 60/460, 461, 466; 91/442, 446
See application file for complete search history.

(56) References Cited

U.S. PATENT DOCUMENTS

| | | | | |
|---|---|---|---|---|
| 3,872,671 | A * | 3/1975 | Verlinde | 60/460 |
| 4,333,389 | A * | 6/1982 | Budzich | 91/446 |
| 5,433,077 | A | 7/1995 | Yoshino | |
| 5,950,429 | A * | 9/1999 | Hamkins | 91/446 |
| 6,112,521 | A * | 9/2000 | Hayashi et al. | 60/460 |
| 6,192,929 | B1 * | 2/2001 | Matsumoto | 91/446 |
| 6,467,264 | B1 * | 10/2002 | Stephenson et al. | 60/460 |
| 6,715,402 | B2 | 4/2004 | Pfaff et al. | |
| 6,865,886 | B2 * | 3/2005 | Jensen et al. | 60/466 |
| 7,121,189 | B2 | 10/2006 | Vonderwell et al. | |
| 7,302,797 | B2 * | 12/2007 | Zhang et al. | 60/422 |
| 7,506,717 | B2 | 3/2009 | Tatsuno et al. | |
| 8,336,443 | B2 * | 12/2012 | Abe et al. | 91/446 |
| 8,479,504 | B2 * | 7/2013 | Kerckhove et al. | 91/446 |
| 2006/0162543 | A1 * | 7/2006 | Abe et al. | 91/418 |
| 2008/0295681 | A1 * | 12/2008 | Ma et al. | 91/446 |

* cited by examiner

*Primary Examiner* — Thomas E Lazo

(57) ABSTRACT

A hydraulic system for a machine is disclosed. The hydraulic system has a source of pressurized fluid, a fluid actuator, and a tank. The hydraulic system utilizes a directional control valve to direct flow between the source, the actuator, and the tank. The hydraulic further utilizes a variable backpressure control valve to control the system backpressure.

18 Claims, 2 Drawing Sheets

HYDRAULIC SYSTEM HAVING A BACKPRESSURE CONTROL VALVE

RELATED APPLICATIONS

This application is based upon and claims the benefit of priority from U.S. Provisional Application No. 61/251,078 by Wesley Thomas Payne, filed Oct. 13, 2009, the contents of which are expressly incorporated herein by reference.

TECHNICAL FIELD

The present disclosure relates generally to a hydraulic system, and more particularly, to a hydraulic system having a backpressure control valve.

BACKGROUND

Machines such as dozers, loaders, excavators, motor graders, and other types of heavy machinery use one or more hydraulic actuators to accomplish a variety of tasks. These actuators are fluidly connected to a pump on the machine that provides pressurized fluid to chambers within the actuators. Valve arrangements are fluidly connected between the pump and the actuators to control a flow rate and direction of pressurized fluid to and from the chambers of the actuators. Valve arrangements may also be fluidly connected between the actuator and the tank to control the back pressure of fluid exiting the actuator.

One valve arrangement for controlling back pressure is disclosed in U.S. Pat. No. 7,302,797 to Jiao Zhang, et al (the "797 patent"). However, it may be beneficial to provide a valve arrangement for controlling back pressure that allows the back pressure to be selectively controlled.

SUMMARY OF THE INVENTION

In one aspect, a disclosed hydraulic system includes a source of pressurized fluid, a tank, a hydraulic actuator, a first valve configured to selectively fluidly communicate the source with the actuator, and a second valve disposed between the first valve and the tank, the second valve being movable between a flow passing position and a flow blocking position. The second valve of the disclosed hydraulic system is biased toward the flow passing position by a pressure signal taken between the first valve and the second valve, and the second valve is either biased toward the flow passing position or the flow blocking by a pilot pressure signal.

DETAILED DESCRIPTION

Figure 1:
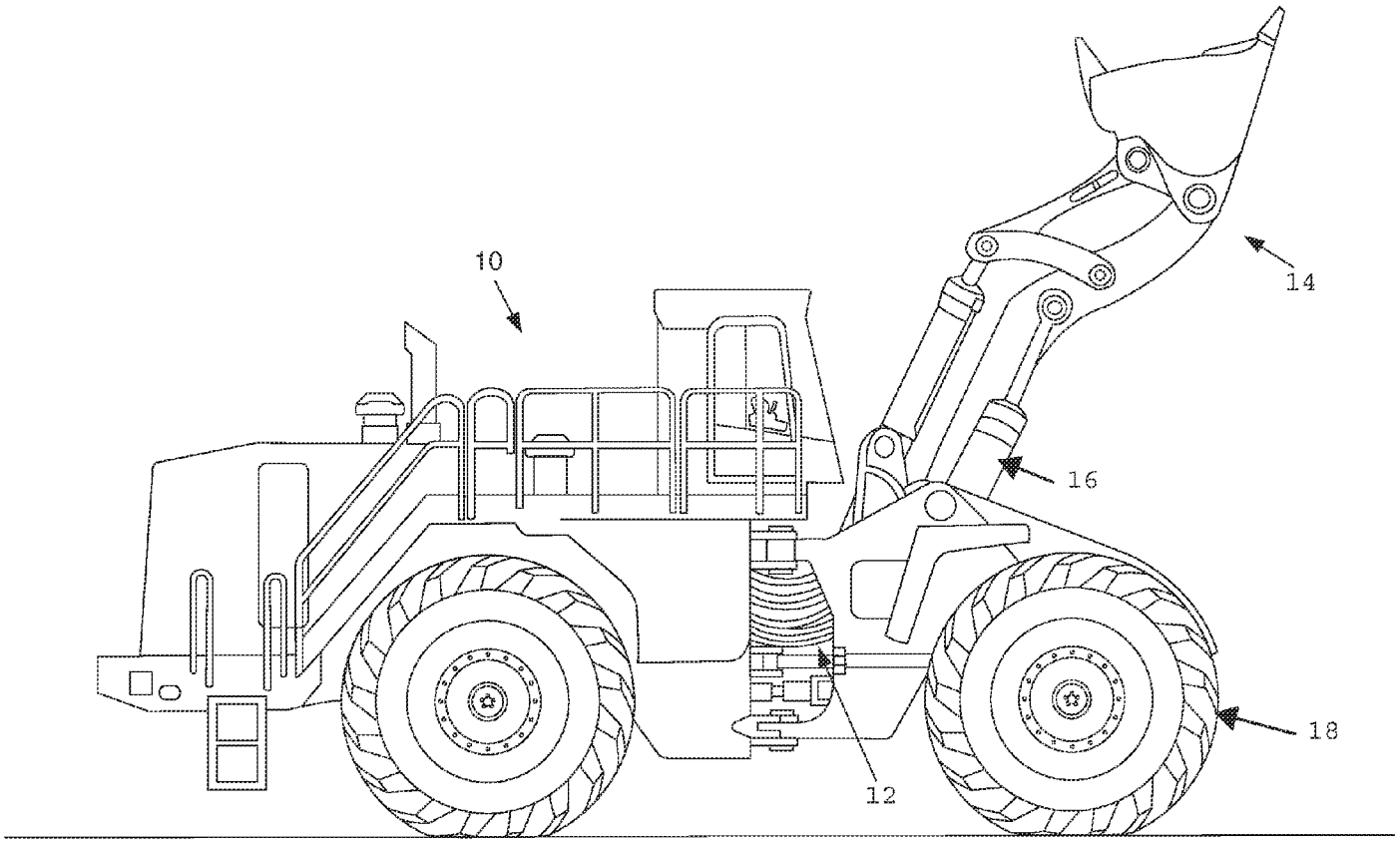
FIG. 1 is a side-view diagrammatic illustration of a machine according to an exemplary embodiment.

FIG. 1 illustrates an exemplary machine 10. Machine 10 may be a fixed or mobile machine that performs operations associated with an industry such as mining, construction, farming, or any other industry known in the art. For example, machine 10 may be an earth moving machine such as a dozer, a loader, a backhoe, an excavator, a motor grader, a dump truck, or any other earth moving machine. Machine 10 may also embody a generator set, a pump, a marine vessel, or any other suitable machine. Machine 10 may include a frame 12, at least one implement 14, and a hydraulic actuator 16 between implement 14 and frame 12.

Frame 12 may include any structural unit that supports movement of machine 10. Frame 12 may be, for example, a stationary base frame connecting a power source (not shown) of machine 10 to a traction device 18, a movable frame member of a linkage system, or any other frame known in the art.

Work implement 14 may include any device used in the performance of a task. For example, work implement 14 may include a blade, a bucket, a shovel, a ripper, a dump bed, a propelling device, or any other task-performing device known in the art. Work implement 14 may pivot, rotate, slide, swing, or move relative to frame 12 in any other manner known in the art.

Figure 2:
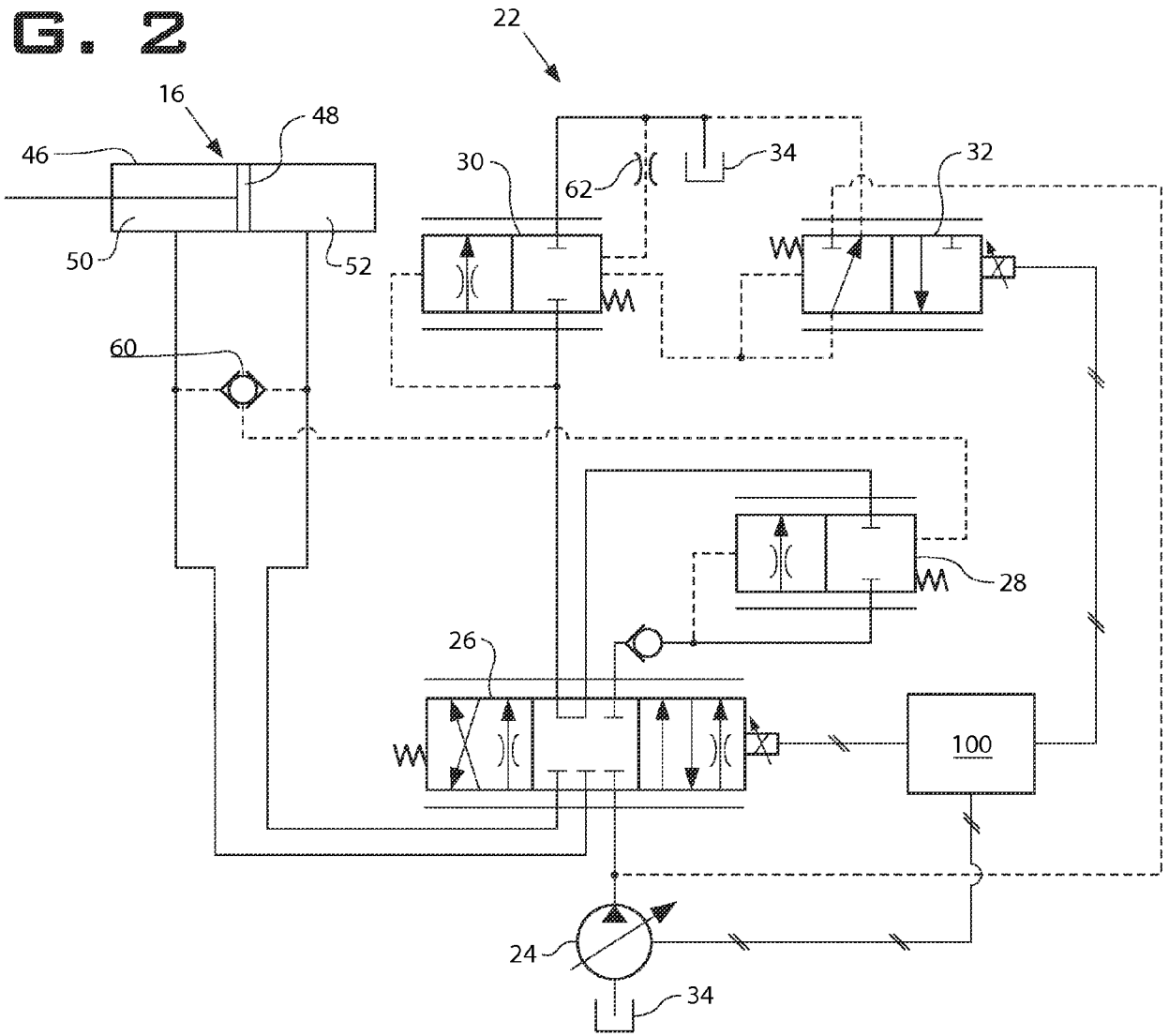
FIG. 2 is a schematic illustration of an exemplary disclosed hydraulic circuit.

As illustrated in FIG. 2, hydraulic actuator 16 may be one of various components within a hydraulic system 22 that cooperate to move work implement 14. Some of the other components of hydraulic system 22 may include a source 24 of pressurized fluid, a tank 34, a directional control valve 26, a pressure-compensating valve 28, a variable backpressure valve 30, and a pilot control valve 32. Hydraulic system 22 may further include a controller 100 for controlling various components of hydraulic system 22, such as a swashplate angle of source 24 and displacement commands sent to various solenoids.

In the disclosed embodiment, hydraulic actuator 16 includes a cylinder having a piston assembly 48 disposed within a tube 46; however, hydraulic actuator 16 could alternatively include a hydraulic motor or another type of hydraulic actuator known in the art. The disclosed hydraulic actuator 16 includes a first chamber 50 and a second chamber 52 separated by piston assembly 48. The first and second chambers 50, 52 may be selectively supplied with a fluid pressurized by source 24 and fluidly connected with tank 34 to cause piston assembly 48 to displace within tube 46, thereby changing the effective length of hydraulic actuator 16, which assists in moving implement 14.

INDUSTRIAL APPLICABILITY

In operation, pressurized fluid from source 24 is directed to directional control valve 26. The illustrated exemplary directional control valve 26 is an infinitely variable six-way valve, movable between three positions. As illustrated a first position of directional control valve 26 passes pressurized fluid from source 24 to the first chamber 50 of the actuator 16 and passes fluid from the second chamber 52 to tank 34. A second position of directional control valve 26 prevents pressurized fluid from source 24 from passing to the actuator 16. A third position of directional control valve 26 passes pressurized fluid from source 24 to the second chamber 52 of the actuator 16 and passes fluid from the first chamber 50 to tank 34. In the illustrated embodiment, directional control valve 26 is actuated by a solenoid; however, directional control valve 26 may be actuated by any means known in the art, such as a hydromechanical pilot valve, an electro-hydraulic pilot valve, or otherwise.

In the illustrated exemplary embodiment, in the first and third positions of directional control valve 26, fluid passes through a pressure-compensating valve 28 before passing to the actuator 16. The exemplary pressure-compensating valve 28 is biased towards an open position by a pressure signal taken between the directional control valve 26 and the pressure-compensating valve 28. Further, the exemplary pressure-compensating valve 28 is biased towards a closed position by both a spring and a pressure signal representing the higher of the pressure of fluid in the first chamber 50 and the second chamber 52, which may be resolved by a shuttle valve 60.

As illustrated in FIG. 2, fluid passing from the actuator 16 to tank 34 passes through a variable backpressure valve 30. The exemplary variable backpressure valve 30 is biased toward a flow passing position by a pressure signal taken between the directional control valve 26 and the variable backpressure valve 30. Further, the exemplary variable backpressure valve 30 is biased toward a flow blocking position by a spring and a pilot pressure signal. Alternatively, the variable backpressure valve 30 may be biased toward a flow passing position by the pilot signal; however, this may require that the spring exert a greater force to balance both the pilot signal and the pressure signal taken between the directional control valve 26 and the variable backpressure valve 30. Variable backpressure valve 30 may also be connected to tank 34 by way of a dampening orifice 62. Dampening orifice 62 may serve to inhibit rapid movements of variable backpressure valve 30.

In the illustrated exemplary embodiment, a pilot control valve 32 controls the pilot pressure signal acting on the variable backpressure valve 30. The exemplary pilot control valve 32 is movable between a first position that decreases the pilot pressure signal by draining pilot pressure signal passage to tank 34 and a second position that increases the pilot pressure signal by connecting source 24 to the pilot pressure signal passage. The illustrated pilot control valve 32 is biased toward the first position by a spring and a pressure signal taken between the pilot control valve 32 and the variable backpressure valve 30. Further, the illustrated pilot control valve 32 is biased toward the second position by a solenoid. In this manner, the pilot pressure signal acting on the variable backpressure control valve 30 may be controlled by controlling a current provided to the pilot control valve 32 solenoid.

By adjusting the pilot pressure signal acting on the variable backpressure control valve 30 the backpressure of the hydraulic system 22 may be selectively controlled. This may be advantageous in various circumstances. For example, it is contemplated that hydraulic system 22 may include various hydraulic circuits controlling various actuators. In this case, there may be times in which increased backpressure may be beneficial for providing make-up flow to reduce voiding in certain circuits, and other times in which decreased backpressure may increase efficiency of the hydraulic system 22. Furthermore, by selectively controlling the variable backpressure valve 30, it may be possible to achieve a specified pressure drop across the directional control valve 26 actuator-to-tank orifice. This may provide more precise control of hydraulic system 22.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system, comprising:

a source of pressurized fluid;

a tank;

a hydraulic actuator;

a first valve configured to selectively fluidly communicate the source with the actuator;

a second valve disposed between the first valve and the tank, the second valve being movable between a flow passing position and a flow blocking position, wherein the second valve is biased toward the flow passing position by a pressure signal taken between the first valve and the second valve, and the second valve is either biased toward the flow passing position or the flow blocking by a pilot pressure signal; and a dampening orifice disposed between the second valve and the tank.

2. The hydraulic system of claim 1 wherein the second valve is biased toward the flow blocking position by the pilot pressure signal.

3. The hydraulic system of claim 1, wherein the pilot pressure signal is controlled by a pilot control valve, and the pilot control valve is movable between a first position decreasing the pilot pressure signal and a second position increasing the pilot pressure signal.

4. The hydraulic system of claim 3, wherein the pilot control valve is biased toward the first position by a pressure signal taken between the pilot control valve and the second valve.

5. The hydraulic system of claim 4, wherein the pilot control valve is selectively biased toward the second position.

6. The hydraulic system of claim 4, wherein the pilot control valve is selectively biased toward the second position by a solenoid.

7. The hydraulic system of claim 5, wherein the pilot control valve is further biased toward the first position by a spring.

8. The hydraulic system of claim 6, further comprising a controller in operative communication with the solenoid.

9. The hydraulic system of claim 1, further comprising a pressure compensating valve fluidly connected between the source and the actuator.

10. A machine comprising:

an implement;

an actuator configured to actuate the implement;

a source of pressurized fluid;

a tank;

a first valve configured to selectively fluidly communicate the source with the actuator; and a second valve disposed between the first valve and the tank, the second valve being movable between a flow passing position and a flow blocking position, wherein a pressure signal taken between the first valve and the second valve biases the second valve toward the flow passing position and a pilot pressure signal biases the second valve toward the flow blocking position, wherein the pilot pressure signal is controlled by a pilot control valve.

11. The hydraulic system of claim 10, wherein the pilot control valve is movable between a first position decreasing the pilot pressure signal and a second position increasing the pilot pressure signal.

12. The hydraulic system of claim 11, wherein the pilot control valve is biased toward the first position by a pressure signal taken between the pilot control valve and the second valve.

13. The hydraulic system of claim 12, wherein the pilot control valve is selectively biased toward the second position.

14. The hydraulic system of claim 12, wherein the pilot control valve is selectively biased toward the second position by a solenoid.

15. The hydraulic system of claim 10, further comprising a pressure-compensating valve fluidly connected between the source and the actuator.

16. A hydraulic system, comprising:

a pump;

a tank;

a hydraulic actuator;

a directional control valve configured to selectively fluidly communicate the pump with the actuator;

a selectively variable backpressure control valve disposed between the directional control valve and the tank, the backpressure control valve being movable between a flow passing position and a flow blocking position, wherein the backpressure control valve is biased toward the flow passing position by a pressure signal taken between the backpressure control valve and the directional control valve, and wherein the backpressure control valve is biased toward a flow blocking position by a pilot pressure signal;

a pilot control valve movable between a first position decreasing the pilot pressure signal and a second position increasing the pilot pressure signal, wherein a pressure signal taken between the pilot control valve and the backpressure control valve biases the pilot control valve toward the first position.

17. The hydraulic system of claim 16 wherein the pilot control valve is biased toward the second position by a solenoid.

18. The hydraulic system of claim 17, further comprising a controller in operative communication with the solenoid.

* * * * *